US009604754B1

(12) United States Patent
Burgos Agudo

(10) Patent No.: US 9,604,754 B1
(45) Date of Patent: Mar. 28, 2017

(54) HERMETICALLY-SEALING DISPENSING LID OF INJECTED PLASTIC MATERIAL FOR PACKAGES OF SOLID PRODUCTS, IN POWDER OR GRAIN FORM

(71) Applicant: Luis Burgos Agudo, Puerto De Sagunto (ES)

(72) Inventor: Luis Burgos Agudo, Puerto De Sagunto (ES)

(73) Assignee: Lubuag Ltd., Sea Port, Victoria, Mahe (SC)

( * ) Notice: Subject to any disclaimer, the term of this patent is extended or adjusted under 35 U.S.C. 154(b) by 0 days.

(21) Appl. No.: 15/140,032

(22) Filed: Apr. 27, 2016

(51) Int. Cl.
*B65D 5/74* (2006.01)

(52) U.S. Cl.
CPC ..... *B65D 5/746* (2013.01)

(58) Field of Classification Search
CPC ..... B65D 5/746; B65D 5/747; B65D 83/06
See application file for complete search history.

(56) References Cited

U.S. PATENT DOCUMENTS 1,619,315 A * 3/1927 Ricketts ..... A47F 1/03 222/364
1,951,515 A * 3/1934 Lyell, Jr. ..... B65D 5/746 119/430
3,187,961 A * 6/1965 Moore ..... B65D 5/76 222/346
3,982,683 A 9/1976 Forteau
4,951,850 A * 8/1990 Clayton ..... B65D 5/746 222/535
5,012,959 A * 5/1991 Gordon ..... B65D 5/746 222/535
5,718,371 A * 2/1998 Smith ..... B65D 5/746 222/528
6,062,467 A * 5/2000 Ours ..... B65D 5/744 229/117.3
6,213,388 B1 * 4/2001 Ours ..... B65D 5/744 229/117.3
8,794,503 B2 * 8/2014 Burgos Agudo ..... B65D 5/744 222/364
9,156,582 B2 * 10/2015 Walsh ..... B65D 5/701
2006/0000880 A1 1/2006 Wein

FOREIGN PATENT DOCUMENTS

FR 2695625 A1 3/1994
GB 511851 A * 8/1939 ..... B65D 5/746

* cited by examiner

*Primary Examiner* — Gary Elkins
(74) *Attorney, Agent, or Firm* — Richard M. Goldberg

(57) ABSTRACT

A hermetically-sealing opening dispensing lid made of injected plastic material for foodstuff packages of solid, dry, powdered or grain products is made up of a movable body hinged to a frame by means of a hinge, the frame is secured to the package by perimeter ridges and ultrasonic welding or by an edge which goes through the wall of the package and joins an inner counter frame, the movable body is made up of two lateral walls with retaining elements which act on tabs placed at the top of the frame, a front wall with a hinged gripping flange, an upper bridge and a lower bridge, the lid is provided with racks spaced from the lateral walls which cooperate with a second pair of tabs, and the bridge may contain a set of parallel ribs preventing the products from going through the movement zones.

27 Claims, 12 Drawing Sheets

HERMETICALLY-SEALING DISPENSING LID OF INJECTED PLASTIC MATERIAL FOR PACKAGES OF SOLID PRODUCTS, IN POWDER OR GRAIN FORM

BACKGROUND OF THE INVENTION

This invention covers a hermetically-resealing injected plastic dispensing lid to be applied to a box-package of the laminated type with at least one plastic coating on one of its faces, said box-package being for containing products such as solids in powder or grain form for foodstuff use, chemical products or animal food.

One example of said packages is what is known as Gable Top, made in the United States of America, commonly used for selling solid products such as processed cereals.

STATE OF THE ART

There are dispensing lids and especially cardboard or metal lids applied to a window made in one side of a cardboard package forming the box, or in some cases formed of the packaging chassis itself. The main problem of these lids is that they do not have a seal to contain the nitrogen barrier and they are not airtight when resealed due to lacking hermetic closing means, and they are not suitable for a sterile or semi-sterile packages with nitrogen added in the package, insofar as the permeability will allow oxygen and/or moisture into the package and consequently the oxidation of the products contained inside this and/or the proliferation of micro-organisms, which will produce the deterioration of the product contained.

Dispensing lids made of cardboard will furthermore not provide a satisfactory solution to dispensing the products and in particular as regards guiding these towards the supply point, for example towards the user's breakfast bowl for supplying and dispensing cereals, facilitating spilling the products to the sides; this is the case of U.S. Pat. No. 3,982,683 or US 2006/0000880, in which the dispensing nozzle has a small central concavity, with a very small radius of curvature, in which said concavity is conceived for facilitating grasping the lid by the user to open this and not to guide dispensing. U.S. Pat. No. 6,213,388 had a frontal deformation which in any event facilitates the product spilling out towards the sides, rather than guiding this to the dispensing point. FR 2695625 combines both characteristics, with a central concavity, which is combined with a convexity towards both sides of the nozzle.

Apart from this, dispensing lids of cardboard packages have inefficient means for retaining these in an open and closed position. Since cardboard is well known to be a soft material it cannot provide any proper mechanical performance, making dispensing difficult in the open position due to there being no retention system, and in the closed position allowing certain impurities, dust or insects to be able to get inside the package through not being able to obtain a suitable hermetic seal.

US 2006/0000880 displays a friction zone between the side walls of the nozzle and the top part of the package, with a cutaway and deformations respectively at the front and rear of said lateral walls for securing in open and closed positions. Closing does not however prove satisfactory due to the poor mechanical rigidity of the cardboard, the inaccuracy in its hinging, also altered by time and use and above all due to the wear of the material of which said nozzle is made, that is, cardboard.

The form of gripping the lid to open this is also a disadvantage. As a general rule, these lids do not have any way of being held, having to be opened by inserting the user's finger or nail between the package and the lid. This is obviously inconvenient and involves poor hygiene conditions. In some cases, the lid extends wider than the hole, leaving a zone in which this can be opened relatively easily, but without significantly bettering the problem described. U.S. Pat. No. 3,187,961 makes an attempt to solve this problem by placing at the top of the lid an outwardly-projecting tab, formed by bending the end of said upper edge. This involves problems for packing the packages since the tab is either so small that this cannot be easily gripped, or if it is big enough, it makes lateral stacking harder, all as well as the sealing problems that have been mentioned above.

The inventor of this invention satisfactorily solved these disadvantages in U.S. Pat. No. 8,794,503. The lid described is designed to be fixed to a package, normally a laminated type or semi-brick package, in which a window is made substantially coinciding with the geometry of the lid; this is made up of a movable body and a frame hinged together by means of a hinge formed of a weakened part of the material with which this forms a single piece, in which the movable body goes through the opening made by said frame, and the movable body is formed of lateral walls joined together by an upper bridge and a lower bridge, and a front wall which constitutes the closing element. The upper bridge is located only at the rear of the movable body, with a decreasing radius of curvature or decreasing plane. The frame is provided with an outer perimeter edge except for the zone in which the hinge is located, in geometrical concordance with the outer edge of the front closing wall of the movable body so that in the closing position said front wall and said edge are flush. The frame is provided with a pair of downwardly pointing tabs, one on each side of the bottom of the upper side, which act as a means of retention in concordance with the upper edge of the side walls of the movable body. The tabs are located in the frame forming a recess of those portions of said frame, being joined to this at the top.

The front and rear edges of the side walls of the movable body were provided with retaining elements acting in cooperation with the tabs.

The outer edge of the front wall of the lid is provided with a gripping flange.

It has nevertheless been observed that some characteristics are not fully satisfactory. In particular shortcomings have been found in the following aspects of said invention:

- The sealing (securing) of the lid to the package was made by hot-melt adhesive, sticking or by riveting lugs in the frame of the lid. The speed of insertion and fixing of the lids by means of these procedures is relatively slow and cannot be adapted to the usual speed of production of laminated packages, such as those of the Gable-top type;
- Riveting is not able to produce sufficiently airtight sealing for holding gases (nitrogen) inside the package;
- This requires the addition of further operations, which will affect the cost as well as having an impact on the production speed, through the addition of a further product (the glue or hot-melt adhesive or heat-riveting) and of the operation involved in applying these;
- In the product made according to U.S. Pat. No. 8,794,503 the curved portion of the lower bridge penetrates through the window of the frame, for which reason the sharp edges of the lower angles used to hit the edge of the frame in high speed folding operations, preventing or hindering assembling the lid properly;

Some of the tabs interacting in the closing and in the opening with the rear toothed edge which forms a rack and the closing wedge of the front part of the side walls are plastically deformed and undergo a gradually loss of the elastic tension in some cases, and especially when the lid is forced open to one of the sides, so that the front of the lid is not properly retained at the end positions of at least one of the sides, particularly in the closing position, affecting the hermetic sealing of the package;

The gripping flange for pulling the lid, as this is defined in U.S. Pat. No. 8,794,503, consists of a small protrusion placed in a fixed position like a bracket, roughly perpendicular to the surface of the lid. In that invention, the flange is placed at the upper edge. Due to the shortness of the protrusion it is difficult and inconvenient to hold for opening, for example when a user has long nails or thick fingers. The position of the flange does not allow proper placing of a closing seal either, as the seal emerging from the upper edge of the lid means that suitable adhesion in this zone is not ensured. Through projecting from the surface of the lid placed on the package, said flange furthermore increases its effective volume and hampers any proper lateral stacking on the side of the package provided with said lid.

The interaction between the toothed edge of the walls and the tabs was not progressive, for which reason the point of contact between both of these was extremely brusque.

The distances found between the different elements of the lid, and particularly between the upper bridge and the lower angle of the upper edge of the frame, allowed certain products to get stuck in the lid in the opening stage, making total opening of the lid difficult or blocking this.

Although they may prove satisfactory in some cases, the lugs described in U.S. Pat. No. 8,794,503 for securing the frame to the package are not an ideal solution for high-speed manufacturing, and are not appropriate to be used in nitrogen-inertised packages as this does not guarantee proper sealing.

The stop located at the rear edge of the upper bridge for preventing over-opening was in a position preventing flush-positioning of the rear edge of the lid with the inner face of the package, so that the resulting step also caused difficulties for completely emptying out the product. Furthermore, as the stop was centred, this enabled horizontal oscillations to both sides in the fully open position.

SUMMARY OF THE INVENTION

This invention consists of an opening lid to be used as part of laminated, cardboard or plastic packages for solid products in powder or grain form, such as foodstuff products, but not limited to these, which means a development and overcomes the shortcomings mentioned for the lid described in U.S. Pat. No. 8,794,503, with the advantages that will gradually be set forth throughout this description.

Just as the lid of U.S. Pat. No. 8,794,503 had a retaining tab on both sides acting with the upper edge of the corresponding side wall of the movable body, the frame of the lid in this invention has two tabs on each of the sides. This means that the tabs located outermost can act in respect of the front edge of the side walls in the same way as was done in U.S. Pat. No. 8,794,503, the closure of the lid being assured by catching the tab in front wedges of the side walls and corresponding recesses close to the front edge, and allows the second pair of tabs to act against racks or teeth. In order to locate the rack or toothed area against which the second tabs act, the upper bridge has been provided with ribs close to and parallel to the side walls, said ribs also being provided with a rack or teeth at the top, which interact with the second pair of tabs set in the frame.

This means that said outer tabs do not undergo wear or early deformation through not needing to act against the rack of the rear ends.

Both the first tabs and the second tabs are preferably 2.5 to 3.5 mm in height with a width of 2.2 to 3.2 mm.

This means that different advantages are obtained; first of all, the stability of the lid in the fully open stage is improved, due to the support of the first tabs at the edges or elevations of the upper edges of the side walls.

Secondly, this means that the retention that the second tabs exert on the rack can be modulated.

The modulation takes place through the gradual increase of the radius of curvature of the ribs from the front of the toothed area to its back part, so that the front part of the toothed area hardly brushes the front edge of the tabs, and the rear edge of the tab is inserted roughly 50% of the height of the gap in the toothed area. The gradual nature of the retention will also be appreciated in the characteristic ratchet rattling noise that can be heard.

When the distance between the side edge and the rib provided with the rack or toothed area has certain values and depending on the type of products contained in the package, there could be some grains stuck in this zone. For this reason the surface of the upper bridge has been designed to be raised in this zone, lying very close to the edge of the frame or the tabs.

Because the rear portion of the upper bridge has a descending plane or radius of curvature, and to prevent grains of the product dispensed from being trapped in that area too, the whole surface of the front part of the upper bridge has been designed with a plurality of ribs arranged in parallel with each other and with the lateral walls, forming a comb which extends right across the width of said bridge, whose upper edge will have a substantially constant radius of curvature (in respect of the rotation axis of the lid) breaking the continuum with the curve of the rear part of the upper bridge. The distance between the ribs will be such that this prevents products from becoming trapped between each pair of these. The front edge of the set of ribs ends in the concave shape of the front edge of the upper bridge.

According to an alternative embodiment to the previous one, the rib comb is located at the bottom where its lower edge is linearly or progressively descending towards the front and it is the upper surface of the bridge which has a constant radius of curvature in respect of the axis of articulation.

In the open position the distance or span existing between the rear of the upper bridge and the frame is preferably from 0.2 to 1.5 mm, and particularly from 0.4 to 0.7 mm.

For a proper alignment of the outer tabs with the upper edge of the side walls, different cutaways have been made in the frame to allow the tabs to be located in a position aligned with the upper edge of the side walls, keeping the proper distance from the frame at its outer end. The distance between the outer tabs and the side of the frame in the cutaway should preferably be from 0.1 to 1.0 mm.

It has been designed for the lid to be able to be joined with the package at high speed. This can be done either before forming the package or at the same time as said forming. The ideal procedure for joining the lid to the package has been considered to be ultrasonic welding. To facilitate the operation, in accordance with a first form of joining these, the frame has been provided at the rear of the join with the package with at least one perimeter ridge and preferably two parallel perimeter ridges surrounding the whole of said frame. The perimeter ridges preferably have an isosceles triangle section, whose outer vertex forms an acute angle. The acute angle preferably has a value from 50° to 80° and the height of the triangle is from 0.1 to 0.5 mm.

According to a second form of join, alternative to the previous one, the frame has an edge which projects from its rear surface, and which during assembly goes through the window made in the package, this being a plastic laminated package. The outer shape of the edge is substantially identical to the interior shape of the window. The edge is designed to occupy roughly half the width of the frame. The thickness of the edge is roughly identical to the thickness of the package, so that after the lid has been assembled, said edge is flush with the inner surface of the package. For proper sealing, a counter frame is fitted on the inside. The counter frame is a fairly thin sheet of plastic material, with a window identical to the window of the frame, and a width of the edge covering at least the inner surface area of the edge and a perimeter portion of the inner surface of the package. As an example, the external shape of the counter frame can be the same as that of the frame. The counter frame adheres both to the edge and to the interior surface area of the package. The join can be made by any means of adhesion, or by means of welding, normally ultrasonic welding.

To adjust the inner edges of the movable body to the inner surface of the package, it has been designed for the rear stop limiting opening to have a triangular section extending outwards from the rear edge of the upper bridge, so that one part is superimposed over the upper bridge and the other part is projecting. The superimposed part of the stop will be roughly equal in length to the thickness of the package. This will specifically rise roughly 1 mm over the upper bridge for the conventional packages used, and in any event the appropriate length to make the inner edge of the lid flush with the inner face of the package. This will mean the rear edge of the upper bridge and of the side walls will be substantially flush with the inner surface of the package.

The triangular section has a substantially vertical front face and an oblique rear face, preferably with an angle not over 45° in respect of the horizontal, so as to facilitate assembly in the manufacturing stage.

The stop is designed to be made up of a continuous element or a set of separate elements extending along the rear edge of the upper bridge. There are specifically three elements, one central and two set at some distance on each side of the central one. This means the rear support is regular, therefore preventing both the possibility of the lid coming completely out of the window of the frame when this is pulled violently, and that of any irregular support at the rear, with the lid open.

To prevent the aforementioned disadvantage in which snagging occurs during the operation of assembling the lid with the movable body going through the window of the frame, the lower angles of both the frame and of the movable body (between the lateral walls 17 and the lower bridge 24), are designed to be rounded (23). More specifically, the radius of curvature of said lower rounded angles is from 0.5 mm to 6 mm.

To obtain a correct hermetic seal of the package with the lid closed, the contact zone (in the closed position) between the movable body and the frame has been designed with a perimeter sealing joint. This sealing joint forms a single piece with the lid and can be placed at the front (outside) of the frame, at the rear of the front wall of the movable body, or in both places. The joint will be a softer material than the plastic of the rest of the cover and will be made by means of double injection, for example, according to known techniques.

It has been observed that the lid in U.S. Pat. No. 8,794,503 tended to bend the front wall after demoulding because a shrink mark was formed in the confluence between the side walls, the lower bridge and said front wall, which gave rise to unwanted tensions. To solve this problem the outer face of the front wall has been given a slight thickening, particularly in the aforementioned zones of confluence. Hence, this thickening is located in said front face, in parallel to the upper and side walls, and extends at the bottom to the hinge.

The package must contain an inert atmosphere in its interior, especially in the manufacturing stage, normally by introducing nitrogen. The lid, as this is described, ensures suitable hermetic sealing for use, but cannot be guaranteed to keep a permanent barrier for nitrogen. For this reason the lid has been fitted with a seal, which has two functions:

A first function is to prevent the nitrogen from getting out of the interior of the package, when this has been filled with a product and provided with a sterile atmosphere.

A second function is to guarantee to the consumer that the package has not been opened.

More specifically, the seal is made in a shape substantially identical to that of the outer edge of the frame although this extends at its bottom beyond the edge of the hinge, so that said seal covers said hinge, surrounding this and reaching a portion of the plane of the package, with sealed securing at said outer edge and on the plane of the package at its lower zone.

This means that the zones more sensitive to permeability, and particularly the zones located at the edges of the hinge, are totally closed and sealed.

According to a specific configuration, the seal is provided with at least one and preferably two flaps which are located at least at one corner and preferably at both upper corners respectively, said flaps being left loosely projecting and not adhering to the front wall. The two flaps enable both right and left-handed persons to be able to remove this extremely easily.

As was already seen, the fixed securing tabs involve the disadvantage of their size having to be small to enable lateral stacking, thus meaning difficulties for their gripping and pulling, and the necessary projecting volume prevents or hinders fitting the seal. To solve this problem the outer surface of the front wall of the movable body has been fitted with a folding gripping flange. The gripping flange is hinged at one of its edges with said front wall. The hinging is determined by a weakening of the material in the zone where both join. The gripping flange can be in a folded position, in which it takes a position in parallel to the lid to which this is joined, or an unfolded, gripping position. This means, without meaning any limitation to this, that the gripping flange can have the required length, normally between 10 and 25 mm, and also the proper width, between 5 and 15 mm. With these dimensions it is easy and convenient to grip with two fingers of one hand, although this could nevertheless be wider without reducing its functionality. The joining zone of the gripping flange and the lid occupies only a central zone of the hinging edge, that is, of the width of the flange, according to a preferential embodiment. The perimeter thickening of the lid is reduced in said joining zone so as to facilitate the folding of the tab. To facilitate the unfolding of the tab, the end opposite to that of the hinging is designed to have an outward curve. The edge of said end can thus be slightly separated from the surface of the front wall when the tab is in the folded position and enables inserting the user's nail to unfold this.

In accordance with the invention this also proposes the securing of the flange in the folded position, in parallel to the lid. To this end, in a preferable embodiment the gripping flange has been designed to be provided with at least one and preferably two windows or gaps. The outer surface of the front wall of the movable body is in turn provided with lugs, in particular with a hooked shape. These lugs are inserted and engaged in the windows of the flange when the flange is in the folded position. The insertion and withdrawal in the respective folding and opening phases takes place against the elastic deformation of the injected plastic material of which the lid is made and, with this, the lugs.

The surface of the gripping flange, located on the outside in the folded position, is preferably rough. This surface area is specifically provided with cross-hatched ridges. The opposite surface is preferably smooth.

BRIEF DESCRIPTION OF THE DRAWINGS

In order to illustrate the following explanation, we are enclosing along with this descriptive report twelve pages of drawings, in which the essence of this invention is represented in twenty-three figures, as an example and with no limitations being meant thereby, in which the following can be appreciated.

Figure 1:
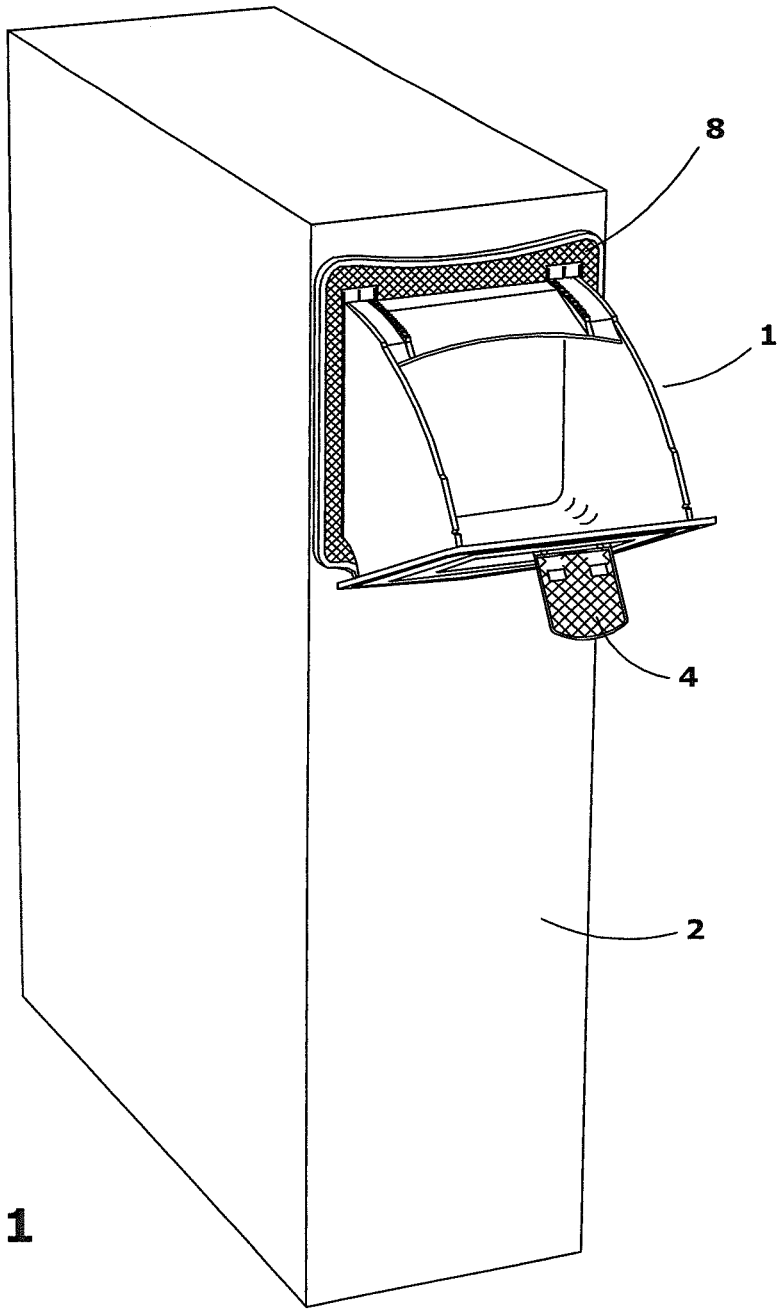
FIG. 1 shows a schematic perspective view of a package provided with the lid of the invention in unfolded position
Figure 2:
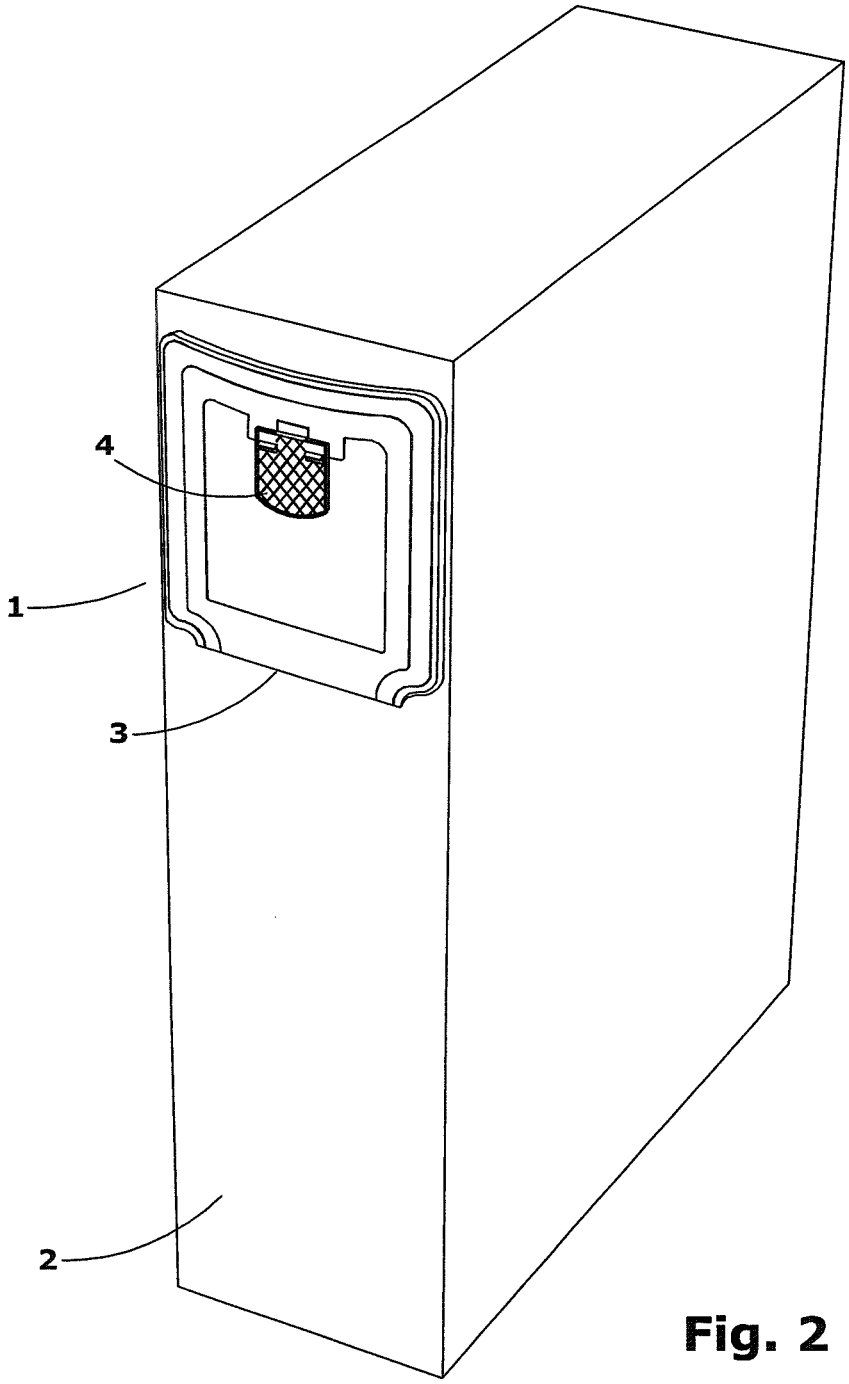
FIG. 2 shows a view similar to that of FIG. 1, with the lid closed.
Figure 3:
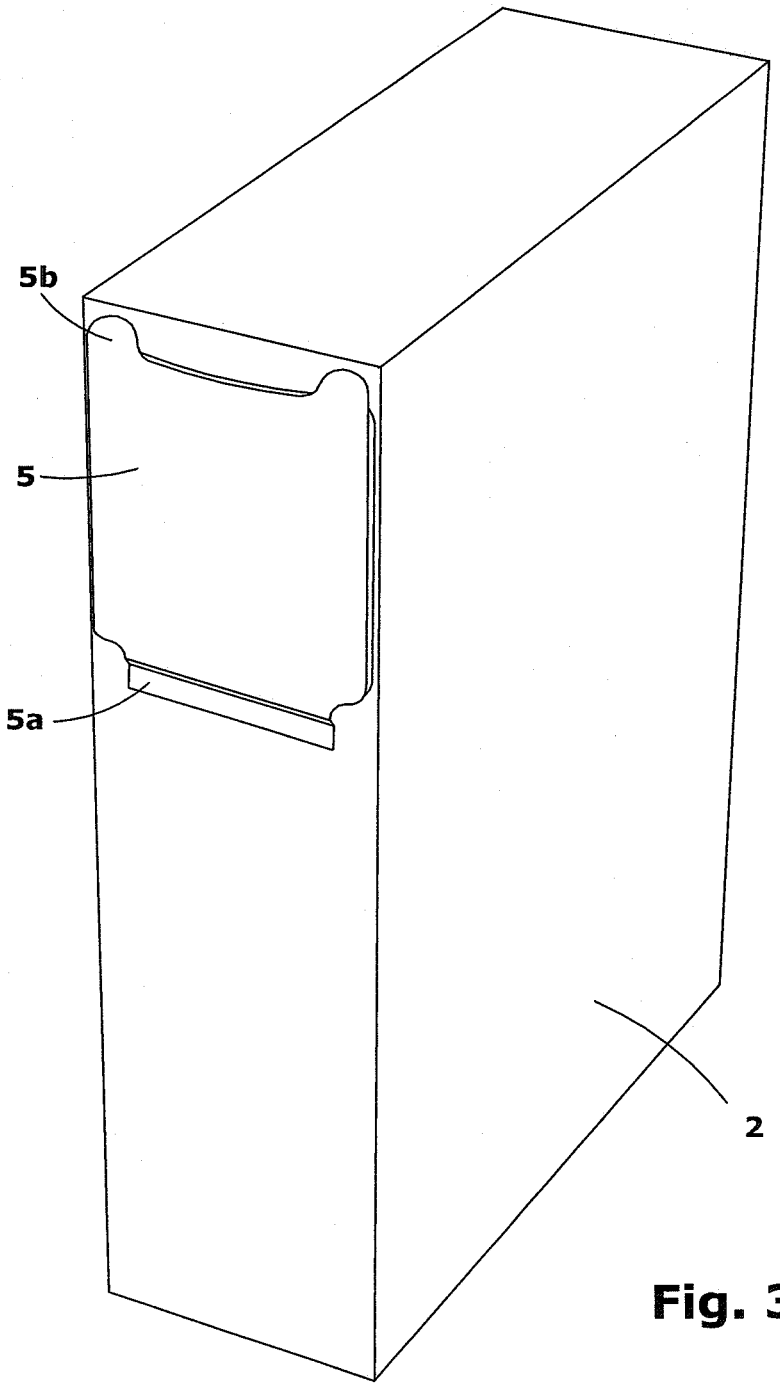
FIG. 3 shows a view similar to that of FIGS. 1 and 2, with the lid provided with a seal.
Figure 5:
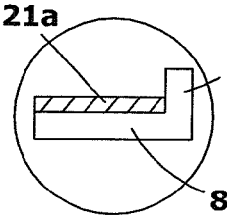
FIG. 5 shows a view of a detail of one option of the closing joint between the frame and the front wall of the movable body, placed in the frame.
Figure 6:
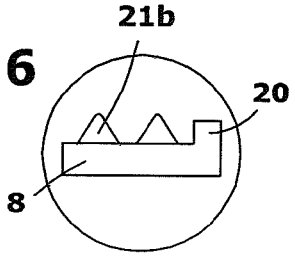
FIG. 6 shows a view of a detail of another option for embodiment of the closing joint with perimeter lips between the frame and the front wall of the movable body, with said joint placed in the frame.
Figure 4:
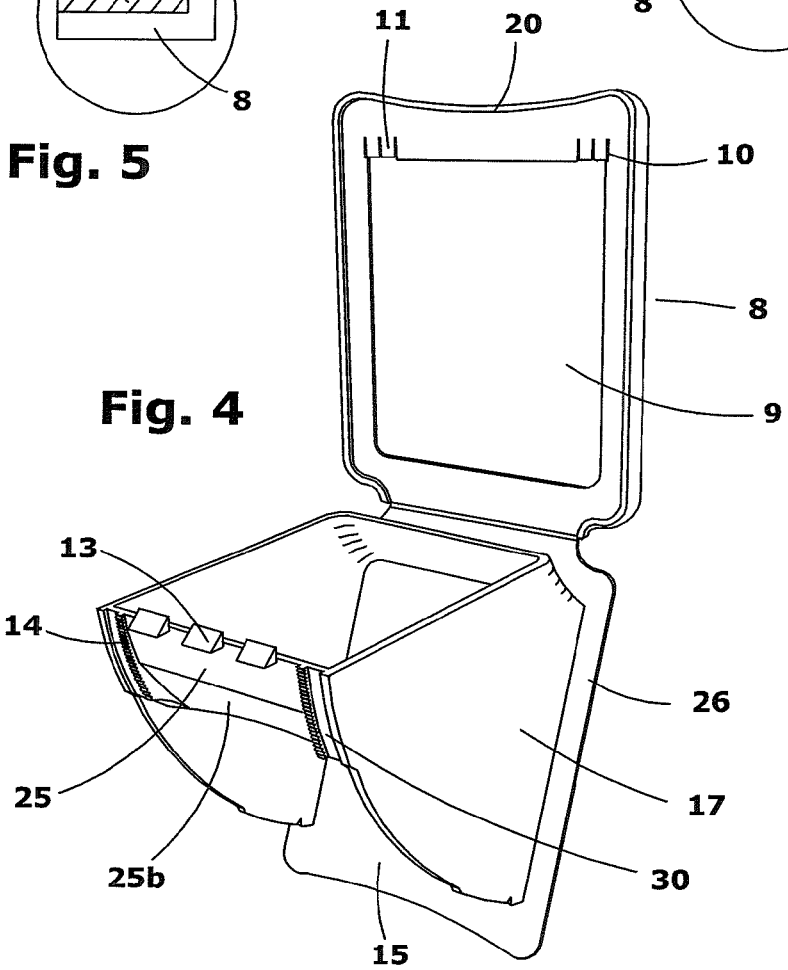
FIG. 4 shows a view similar to that of FIGS. 1 to 3, with the frame placed over the package and the movable body still not inserted in the window.
Figure 7:
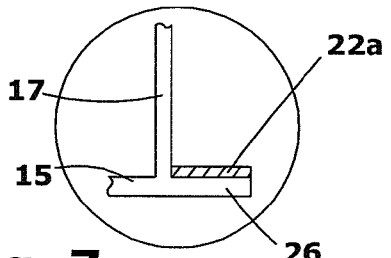
FIG. 7 shows a view of a detail of one option of the closing joint between the frame and the front wall of the movable body, with said flat joint placed on the rear side of the front wall.
Figure 8:
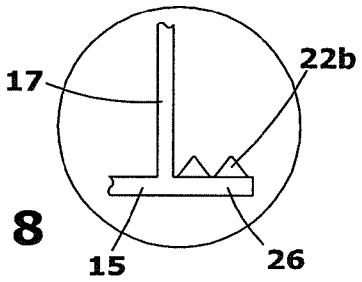
FIG. 8 shows a view of a detail of another option for an embodiment of the closing joint, with said joint formed by two perimeter lips, placed on the rear side of the front wall.
Figure 9:
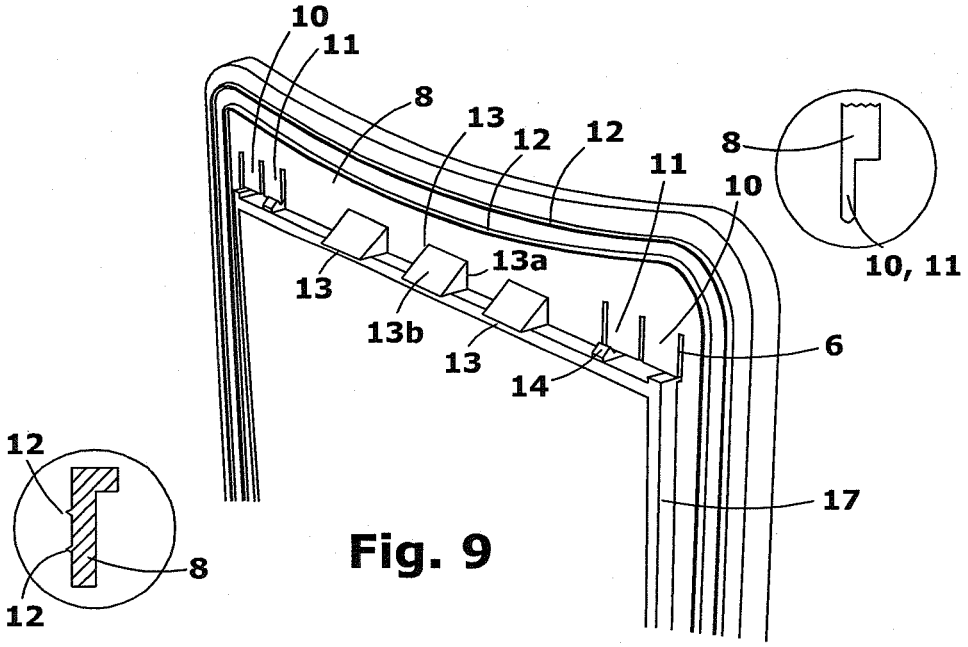
FIG. 9 shows a schematic view of part of an open lid seen from the rear face, according to a form of embodiment of the sealing with the package by ultrasonic means.
Figure 10:
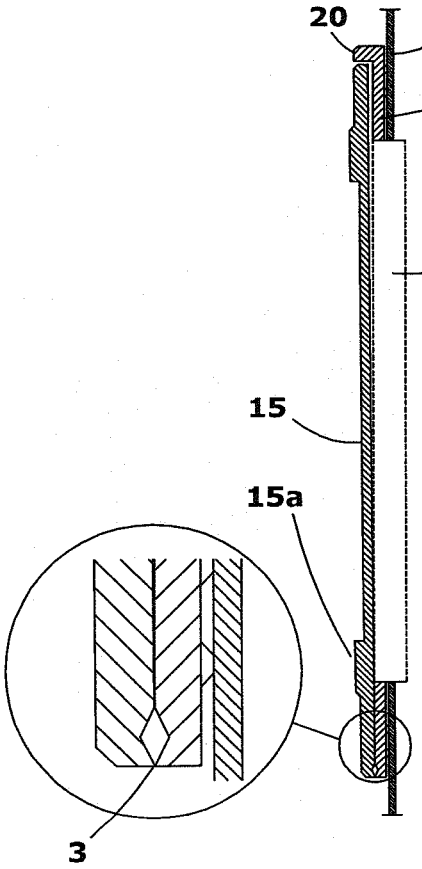
FIG. 10 shows a cross-section view of the lid fitted on the package, as well as a detail of a first form of joining the lid with the package.
Figure 11:
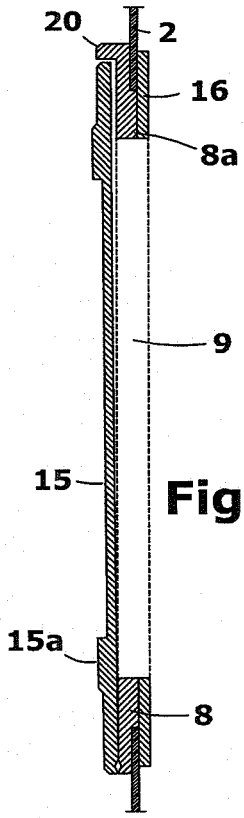
FIG. 11 shows a cross-section view of the lid fitted on the package, as well as a detail of a second form of joining the lid and the package with a counter frame.
Figure 12:
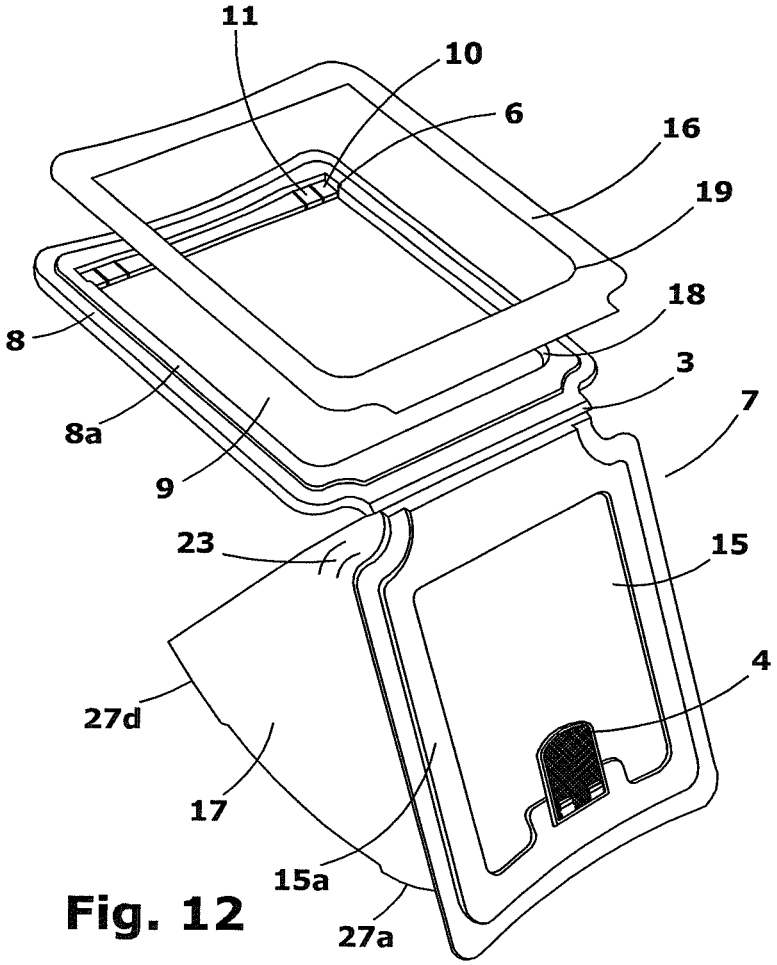
FIG. 12 shows a perspective view of the lid of FIG. 6 and of the counter frame from another point of view.
Figure 13:
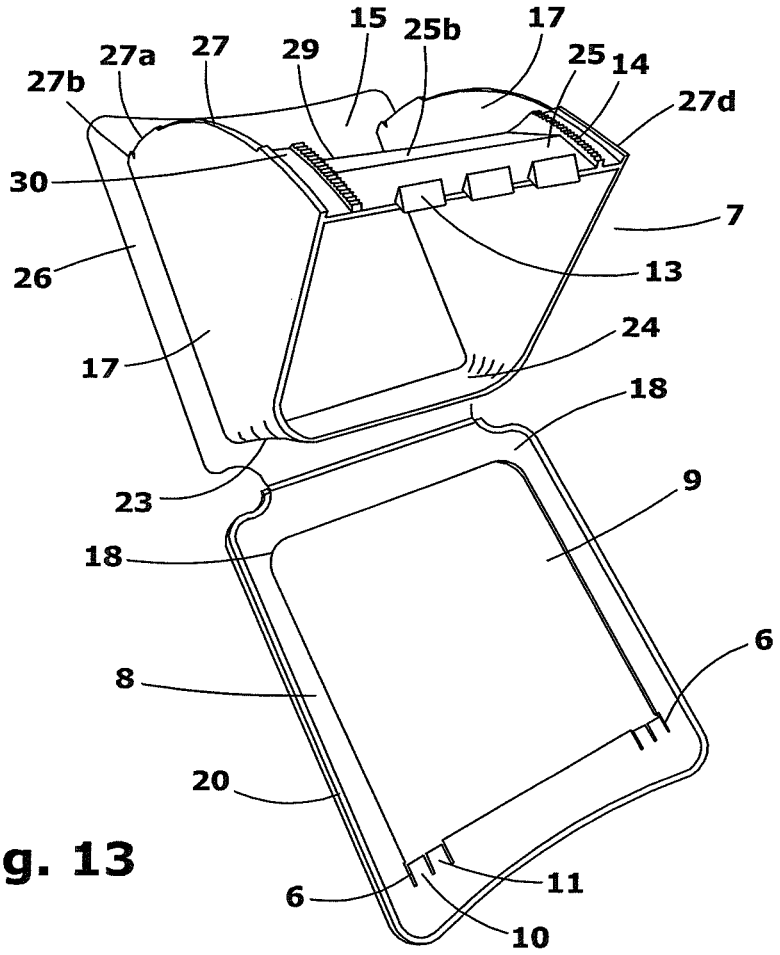
FIG. 13 shows a view of the open lid, without being fitted on the package, in which one can appreciate the curve of the join between the lower bridge and the side walls and of the position of the frame with the lower bridge going through this.
Figure 14:
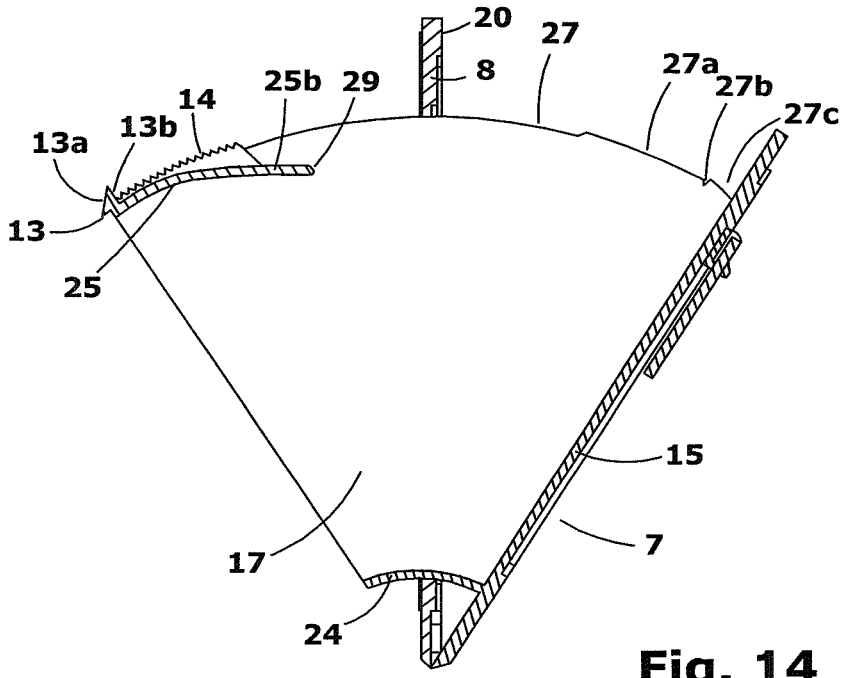
FIG. 14 shows a cross-section of the half-open lid fitted on the frame.
Figure 15:
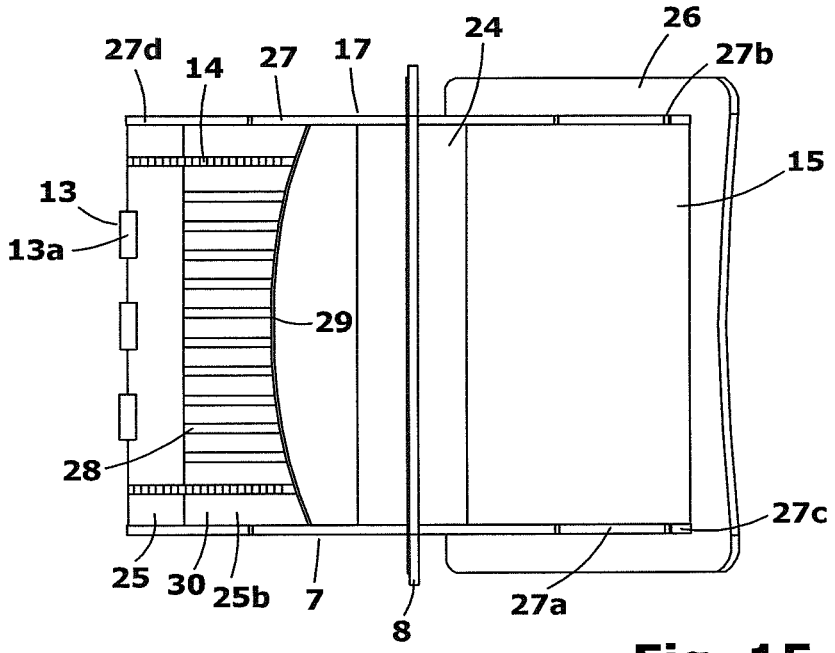
FIG. 15 shows an upper view of the lid in a half-open position.
Figure 16:
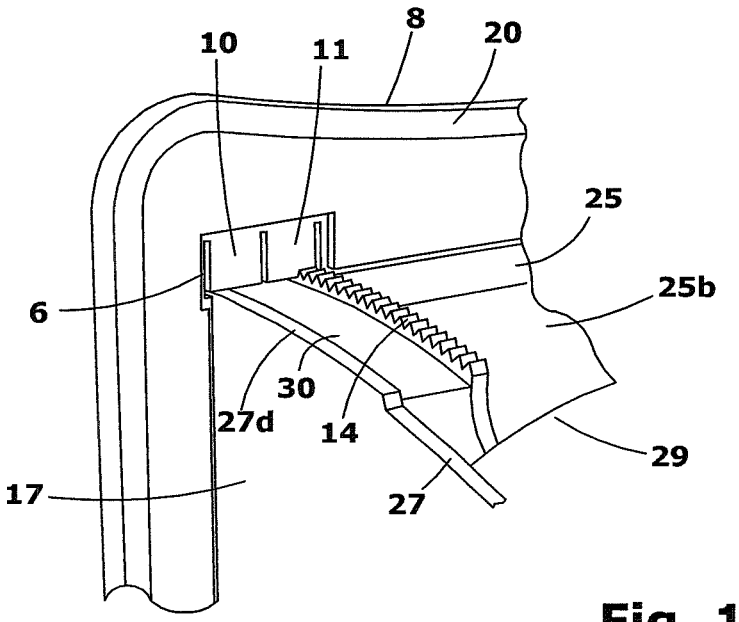
FIG. 16 shows a perspective view of part of the lid in open position, in which one can appreciate one of the pairs of tabs and the retaining rack.
Figure 17:
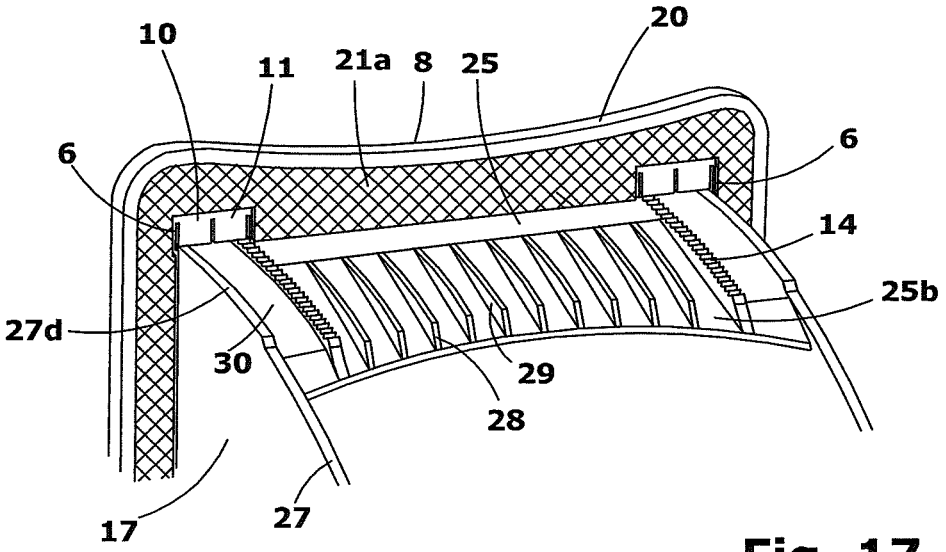
FIG. 17 shows a perspective view of the upper bridge of the lid, provided with a set of ribs forming a comb at the top.
Figure 18:
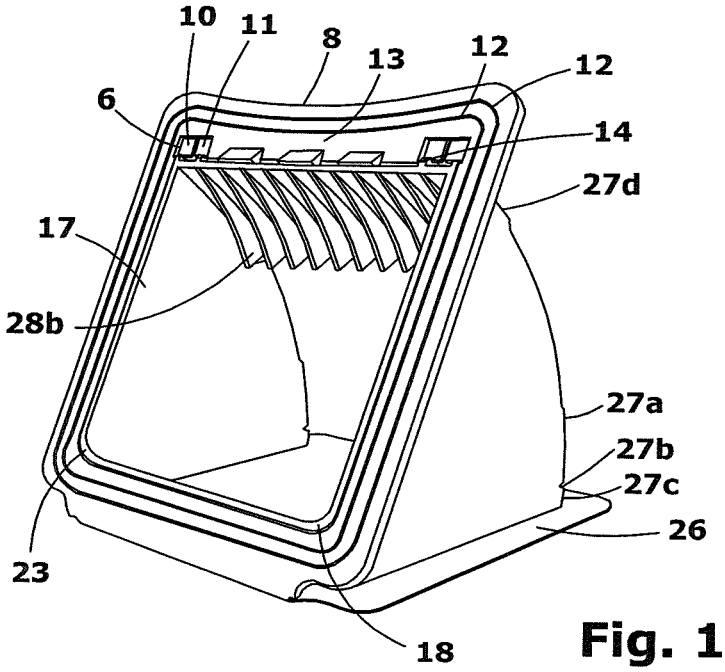
FIG. 18 shows a perspective view of the upper bridge of the lid, provided with a set of ribs forming a comb at the bottom.
Figure 19:
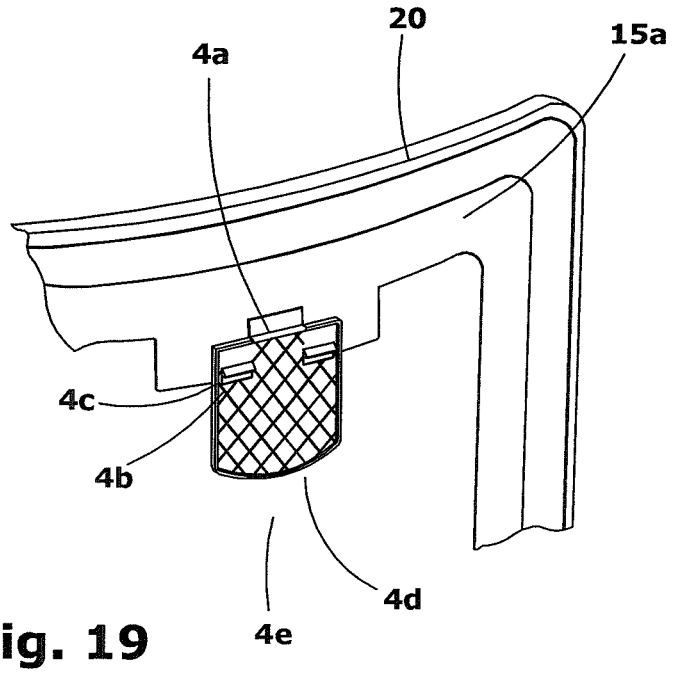
FIG. 19 shows a front perspective view of the lid provided with a closing tab in its folded position.
Figure 20:
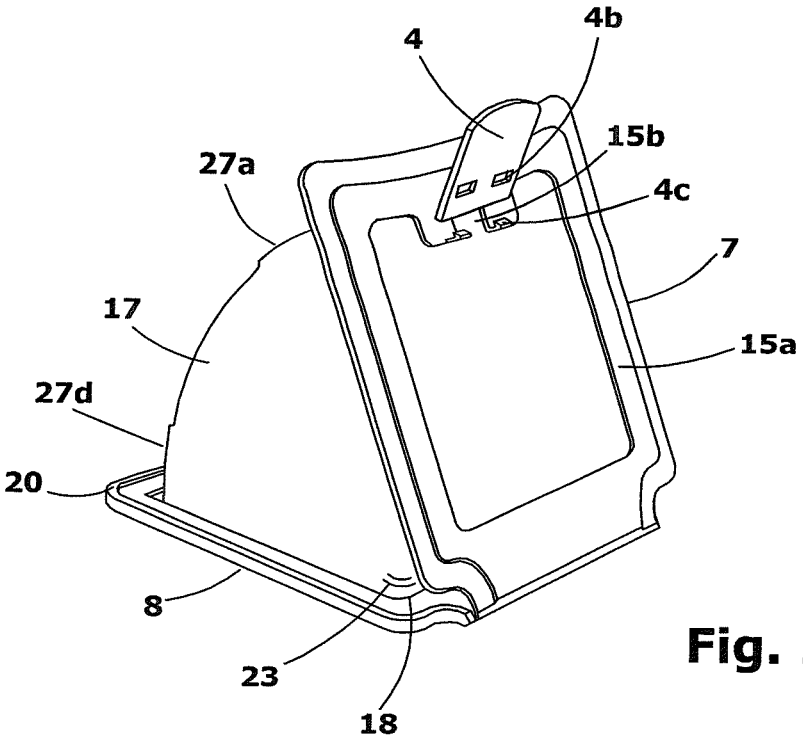
FIG. 20 shows a perspective view of the lid in which one can appreciate the closing tab in its unfolded position.
Figure 21:
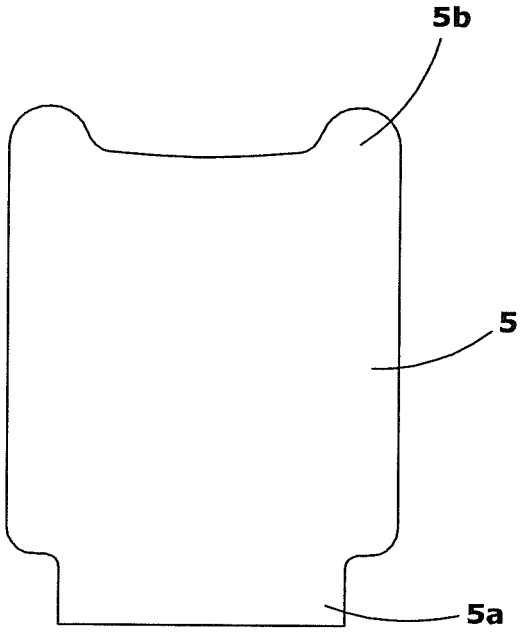
FIG. 21 shows a front view of the closing seal according to a preferential embodiment.
Figure 22:
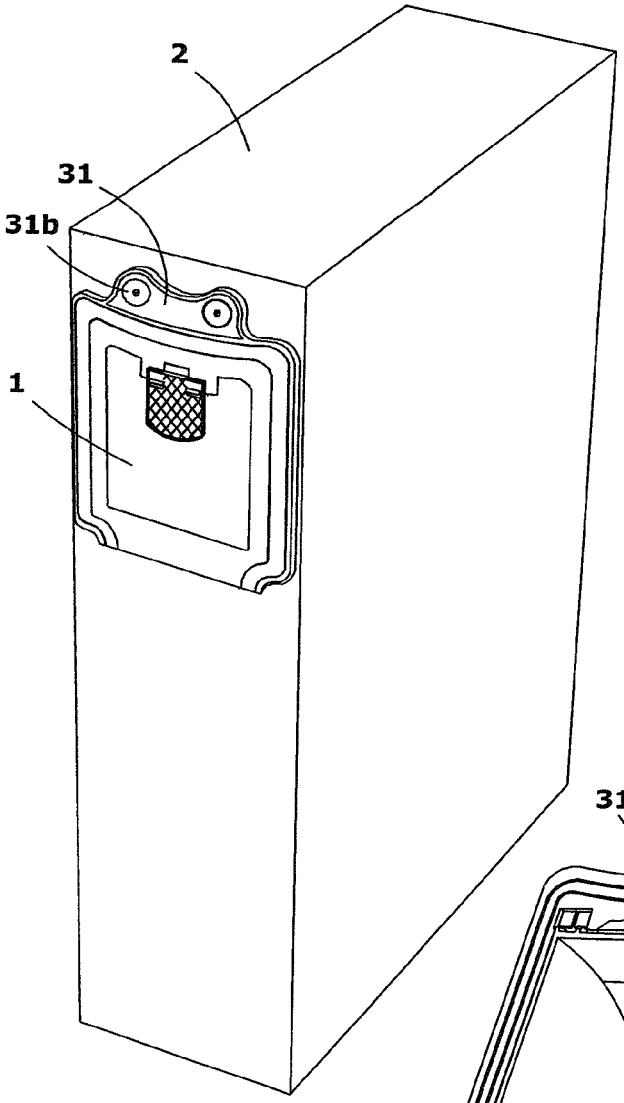
FIG. 22 shows a perspective view of a package with a lid having gas charging and discharging valves integrated in the frame.
Figure 23:
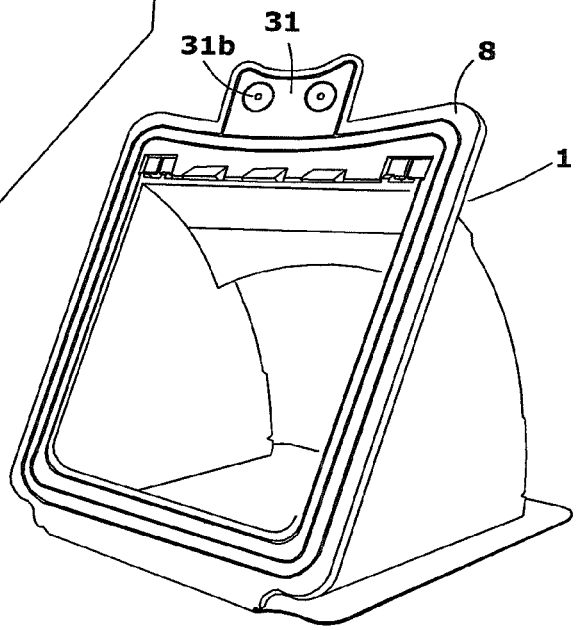
FIG. 23 shows a perspective view of the lid, from the rear part, in which an extension in the frame can be seen, where the gas charging and discharging valves are placed.

The following reference numbers are used in said figures:

1 Dispensing lid, as an assembly
2 Package to which the dispensing lid is applied
3 Hinge of the lid
4 Gripping flange
**4*a*** Hinge of the gripping flange
**4*b*** Windows for securing the gripping flange
**4*c*** Hook-shaped lugs
**4*d*** Surface roughness of the gripping flange
**4*e*** Raised edge of the flange
5 Seal
**5*a* Portion of the seal covering the hinge 3**
**5*b* Opening flaps of the seal 5**
6 Cutaways at the top of the lateral edges of the frame
7 Movable body of the lid 1
8 Frame of the lid
**8*a*** Interior perimeter edge of the frame which is inserted in the window of the package
9 Window in the frame of the lid
10 First, outer tabs
11 Second, inner tabs
12 Perimeter ridges for welding the frame on the package
13 Opening stop of the movable body
**13*a* Rear of the opening stop 13**
**13*b* Front of the opening stop 13**
14 Rack or toothed area
15 Front closing wall of the movable body
**15*a*** Perimeter thickening of the lid
**15*b*** Reduction in the perimeter thickening of the lid
16 Counter frame
17 Lateral wall of the movable body
18 Curve at the intersection between the side edges and the lower edge of the frame 8
19 Curve at the intersection between the side edges and the lower edge of the counter frame 16
20 Perimeter edge of the outer face of the frame 8
**21*a*** Sealing joint on the outer face of the frame
**21*b*** Closing sealing ribbing on the outer face of the frame
**22*a*** Sealing joint on the inner face of the front wall

22*b* Closing sealing ribbing on the inner face of the front wall
23 Curve between the lower bridge and the side walls of the movable body
24 Lower bridge
25 Upper bridge
25*b* Descending portion of the upper bridge
26 Perimeter brim of the front wall
27 Upper edge of the side walls of the movable body
27*a* Raised front part of the lateral wall
27*b* Slot in the front part of the lateral wall
27*c* Wedge-shaped front end portion of the lateral wall
27*d* Raised rear portion of the lateral wall
28 Upper comb of ribs in the descending portion of the upper bridge
28*b* Lower comb of ribs in the upper bridge
29 Front edge of the upper bridge
30 Lateral zones between the racks 14 and the side walls 17
31 Frame extension
31*b* Respective Inert gas and air charging and discharging valves

DETAILED DESCRIPTION

According to the invention, a dispensing lid (1) is described, made of injected plastic material, and which, in the closed position, makes a hermetic seal between a fixed part (6) which is secured to a laminated-type package (2) and a movable body (7). The fixed part is made up of a frame (8) which is welded to the package (2), and which defines a window (9) through which the movable body (7) is displaced and the products are dispensed. Said fixed part (6) and said movable body (7) are hinged together by means of a hinge (3). In its open position the movable body (7) has the function of a dispensing mouth. The outer face forming the front wall (15) of the movable body (7) is fitted with a gripping flange (4). The movable body (7) is made up of a front wall (15), two lateral walls (17), an upper bridge (25) and a lower bridge (24), and in the closed position this is inserted inside the package (2). The front wall (15) is fitted with a perimeter brim (26) which extends beyond the lateral walls (17) and lower bridge (24), as well as beyond the imaginary line joining the intersection of the upper edge (27) of each of the lateral walls (17) with said front wall (15). In the closed position the perimeter brim (26) rests on the frame (8), making a hermetic seal by means of a joint (21*a*) formed or placed on the outer face of the frame (8) and/or a joint (22*a*) formed or placed on the inner face of the perimeter brim (26) of the front wall (15), the front wall being made flush with the perimeter edge (20) formed in said wall (8).

The upper bridge (25) has two portions: a rear portion that is substantially flat or with a constant radius (as seen in a lateral section), and a front portion (25*b*) that is descending or with a decreasing radius. This front portion (25*b*) is finished off in a front edge (29) which has a concave curve.

This movable body (7) also has an opening stop (13) and means for retaining this body in the open and closed positions. For this purpose the frame (8) is provided with tabs (10,11) which perform the function of retaining and locking the movable body (7), both in the open position and in the closed position, thus ensuring great safety and convenience.

The lid (1) has been observed to enable better insertion of the movable body (7) in the window (9) of the frame (8) from the manufacturing position, fully open, when the lower angles are rounded, as opposed to when said angles are sharp. To this end the frame (8) has been provided with rounded lower angles, forming a curve (18) between its lateral edges and its lower edge. Similarly, the intersection between the lower bridge (24) and the lateral walls (17) of the movable body (7) forms a slight curve (23) with no sharp edges, in concordance with the curve of the frame (8). As well as ensuring smoother operation in the process of opening and closing the lid, this means that any unwanted snagging can be prevented during the assembly of the lid (1) on the package (2), and in particular in the folding operation. More specifically, the rounded angles have a radius of from 0.5 mm to 6 mm.

The frame (8) has been provided with at least a second pair of inner tabs (11) at the lower edge of its upper side. The first, outer, tabs (10) act on the upper edge (27) of the lateral walls (17). Likewise, the racks (14) or toothed area for retention at the final phase of opening are located on the ribs, placed in parallel with the lateral walls (17), in accordance with said second, internal, tabs (11). This entails less effort and wear of the surfaces and keeps the elasticity of the tabs (10,11) in use.

The racks (14) have a downward curve with a slight reduction in the radius in respect of the rotation axis constituting the hinge (3); in order to ensure a smoother interaction between the toothed area of the rack (14) and the second tabs (11), the curve forming said rack (14) has been made with a reduction in the radius of curvature (of the distance to the centre of rotation in respect of the hinge (3) to its front), so that when the tab (11) comes into contact with the toothed area of the rack (14) it does so barely brushing the top of the first tooth, while when it contacts the last one, the tab (11) goes into the gap or hole between the teeth down to half of the height of said teeth.

At their upper edge (27) the lateral walls (17) of the movable body (7) have several portions in which the central portion does not come into contact with the tabs (10) in the positions in which this is aligned with the frame (8):

- A rear portion (27*d*) in which its radius of curvature is slightly greater than that of its central portion; said raised area interacts with the first, outer tabs (10); in the phase close to when the movable body (7) is fully opened, this raised area comes into contact with, and is slightly pressed by, the first tabs (10). This is a way to limit the capacity of movement and deformation of the movable body (7), preventing any rocking and improving the stability of the lid (1) in the open position;
- A front portion (27*a*), in which the radius of curvature in respect of the rotation axis is also greater than that of the central portion and substantially equal to that of the rear portion (27*d*); in the phase close to closure of the movable body (7), this raised area also comes into contact with, and is pressed slightly by, the first tabs (10);
- A wedge-shaped front end portion (27*c*), whose edge is linearly descending until this joins the front wall, with its front part slightly higher than the front portion (27*a*);
- A slot (27*b*) located between the front portion (27*a*) and the wedge-shaped front end portion (27*c*), with a depth such that the tabs (10) do not go in as far as to touch the bottom of said slot (27*b*).

The unwanted entry of products in narrow zones or recesses must be prevented, due to limiting the mobility or hampering total opening or closing. In a cross-section, the front descending part (25*b*) of the upper bridge (25), has at least certain lateral zones (30) located between each of the ribs or raised parts forming the racks (14) and the corresponding lateral wall (17). These lateral zones keep the radius of curvature in respect of the hinge (3) along substantially all their length.

In accordance with one option for embodiment of this invention, the upper surface of the front of the upper bridge (25) is provided with a set of parallel ribs forming a comb (28), with a radius of curvature at the top in respect of the hinge (3), substantially equal to the radius of curvature of the rear of said upper bridge (25), and in which the front edge of the upper bridge (25) with the set of ribs has a concave curvature. This means that the ribs start at the intersection between the front and rear portions of the upper bridge (25), and end at the front concave edge of said upper bridge (25). The distance between the ribs is such that this prevents the packed products from getting between these. These ribs also make the movable body (7) of the lid (1) extremely rigid.

According to another option the upper bridge (25) has an upper surface with constant curvature (in respect of the hinge 3), and it is the bottom part which is provided with a comb (28*b*) of parallel ribs; in this case it is the lower edge of the ribs which is descending.

In the open position, the distance (the span) between the frame (8) and the rear of the upper bridge (25) is from 0.2 to 1.5 mm, and particularly from 0.4 to 0.7 mm.

For the first, outer, tabs (10) to interact properly with the upper edge (27) of the lateral walls (17), said tabs (10) must be aligned with the lateral edges of the frame (8). For this purpose cutaways (6) facing outwards have been designed in the frame (8), at the top of its lateral edges, which enable keeping the required clearance of the first tabs (10) in respect of the lateral edge, at the same time as the outer edge of said tabs (10) is aligned with the respective lateral edge of the frame (8).

The cutaways (6) leave a distance of from 0.1 to 1.0 mm between the first outer tabs (10) and the corresponding lateral edge of the frame (8).

The tabs (10,11) are 2.5 to 3.5 mm high and 2.2 to 3.2 mm wide. Their thickness is from 0.3 mm to 0.7 mm.

The rear of the upper bridge (25) is provided with at least one stop (13) which limits the degree of opening of the lid (1). In order to prevent excessive opening, the stop (13) has a substantially radial front part (13*a*) (vertical in the open position). For easy assembly the rear (13*b*) of the stop is oblique, so that this facilitates the deformation of the movable body (7) in the assembly operation, meaning that the stop (13) has a substantially triangular or wedge-shaped section. To be able to adjust the rear edges of the lateral walls (17) to the frame (8) without these projecting significantly towards the inside of the package (2), in the open position, the stops (13) have been designed to project or emerge some length towards the rear of the upper bridge (25) of the movable body (7). There are preferably three stops (13), arranged along the rear edge of the upper bridge (25).

For assembling the lid (1) in the package (2) in one option it has been designed for the frame (8) to be fitted, at its rear face facing towards the package, with at least one perimeter ridge (12), and preferably two parallel perimeter ridges, with a triangular section, whose vertex forms an acute angle; these ribs (12) allow ultrasonic welding with the outer plastic coating which is normally applied to the laminated packages to which this lid (1) is applicable. The acute angle preferably has a value of from 40° to 100°, particularly from 50° to 80°, and the height of the triangle is from 0.1 to 0.5 mm.

According to another option alternative to the previous one, the frame (8) is provided, at its rear face facing the package (2), with a perimeter edge (8*a*), which surrounds the window (9) covering approximately half of the width of the sides of the frame (8). The height of this perimeter edge (8*a*) is approximately the same as the thickness of the material of which the package is made, and the outer shape of said edge is substantially the same as that of the window made in the package (2) in which this has to be fitted. For assembling this a counter frame (16) is used, which is placed from the inside of the package (in its manufacturing phase) and which is formed of a piece of plastic material which has an interior hole or window the same as that of the window (9) of the frame (8) and in which the width of its sides is at least equal to that of the two sides of the frame (8). The counter frame (16) is joined to both the portion of the edge (8*a*) which goes through the package (2) and to the corresponding contour in the inner surface of the package (2) by means of welding, for example by means of ultrasound, or using a chemical adhesive compatible with foodstuff products, as the case may be. The counter frame (8) has also been provided with rounded lower angles, forming a curve (19) between its lateral edges and its lower edge.

According to any of the above options, this means that there is a total seal between the package (2) and the frame (8) of the lid (1).

One problem which is also solved by the lid of the invention is that of a proper hermetic seal in the closed position. For this purpose, the closing zone between the frame (8) and the front closing wall (15) is provided with a sealing joint (21*a*, 22*a*). The sealing joint (21*a*, 22*a*) can be placed on the front surface of the frame (8), on the rear surface of the perimeter brim (26) of the front wall (15), or on both. The sealing joint (21*a*, 22*a*) will be formed as a single piece with the front wall (15) and/or with the frame (8) and injected with a softer material than the material of said lid or said frame (8).

The sealing joints (21*a*, 22*a*) of the lid and/or of the frame (8) may be smooth or rough, covering the total width of the contact between the lid and the frame (8) in the closed position, with a flat or undulated section and/or provided with one or more perimeter ridges (21*b*, 22*b*), preferably two.

The front wall (15) is substantially flat; it is nevertheless provided on its outer face with a slight thickening (15*a*) placed in parallel and at a certain distance from the outer edge; extending at the bottom as far as the hinge (3), leaving a smooth perimeter portion at the lateral and upper edges.

In accordance with the invention, the lid (1) is designed to be fitted with an airproofing, sealing and safety seal (5). This seal (5) covers all the opening join zones between the front wall (15) and the frame, and extends as far as the surface of the package (2) on which this is placed.

According to one option the seal (5) can totally cover the front wall (15) and the front surface of the perimeter edge (20) of the frame (8), and is provided with a portion (5*a*) which extends below as far as the package (2), so that said seal (5) covers said hinge (3) surrounding this and reaching a portion of the plane of the package (2), with airtight fixing at said outer edge and at the plane of the package in its lower part. The seal (5) may be stuck to the lid (1) and to the corresponding portion of the surface of the package by means of ultrasonic welding.

According to another option, the seal (5) totally envelopes the lid (1) and extends around this as far as the surface of the package (2) along its whole perimeter.

For easy opening of the seal (5) this is designed to be fitted with at least one flap (5*b*) which is located at one of the upper angles. The seal (5) is preferably fitted with two flaps (5*b*) at the two upper angles, said flaps (5*b*) being left loosely projecting and not adhering to the front wall (15).

The front wall (15) of the movable body (7) is provided with a gripping flange (4) hinged at one of its angles in respect of said front wall (15) forming a hinge (4*a*). The hinge (4*a*) between the gripping flange (4) and the front wall (15) is determined by a weakening of the material at the zone where these join; said gripping flange (4) may take a folded position, in parallel to the lid to which this is connected, or an unfolded position, for gripping, which may be positioned in different degrees of unfolding.

For the hinging between the gripping flange (4) and the front wall (15) not to be hindered by the material of the front wall (15) itself, it has been designed for the perimeter thickening (15*a*) of the lid to have a certain recess (15*b*) in the hinging zone to provide housing for the weakened part constituting the hinge (4*a*). According to one option, the hinge (4*a*) of the gripping flange (4) occupies only a central portion of the width of said flange.

The end of the gripping flange (4) opposite to the end of the hinge (4*a*) has a curve towards the outside, so that the edge (4*e*) of said end is slightly raised, that is, separated from the surface of the front wall (15) when the flange is in the folded position, so that this facilitates its easy extraction by inserting a nail, or even the end of the finger.

The gripping flange (4) is provided with at least one and preferably two windows or gaps (4*b*); the outer surface of the front wall (15) of the movable body (7) is provided in turn with hook-shaped lugs (4*c*); in the folded position the lugs (4*c*) are inserted into said windows (4*b*) so as to hook and retain the flange (4) in its folded position. The folding of the gripping flange (4) over the front wall (15) is done simply by pressing, so that the hook shape of the lugs (4*c*), enables a slight elastic deformation, until the outer edge of the windows (4*b*) has reached the transversal portion of the lugs, at which point the elastic deformation of the lugs recovers, giving rise to the retention.

According to one preferable option of embodiment, the outer surface of the gripping flange (4) is rough (4*d*) in the folded position, and the opposite surface to this is smooth.

Finally, it is foreseen that the frame (8) is provided with an extension (31) with one or more valves (31*b*) which allow the injection of inert gas and extraction of the air inside the package. The valves (31*b*) could also be placed at the front wall (15).

What is claimed is:

1. A hermetically-sealing opening dispensing lid made of injected plastic material for a foodstuff package for holding solid, dry powdered or grain products, said lid comprising: a frame which is secured to the package, with the package including an opening, and the frame secured at the opening to form a window;

a movable body hinged at an edge of the frame by a hinge formed of a weakening of a join between said frame and said movable body, which permits pivoting movement of the movable body about the hinge for opening and closing through the window of the frame, said movable body including:

two lateral walls with a first radius of curvature at upper edges of the lateral walls and a second smaller radius of curvature at lower edges of the lateral walls, a closing front wall and two joining bridges, including a lower joining bridge which joins bottoms of the lateral walls together, and an upper joining bridge which joins tops of the lateral walls together at rear portions thereof;

wherein the upper bridge has two parts, a front part closer to the closing front wall, and a rear part further from the closing front wall, the rear part having approximately a constant radius of curvature, and the front part one of:

has a decreasing radius of curvature and is in a decreasing plane;

wherein the frame is provided with an outer perimeter edge except for a zone in which the hinge is located, in geometrical concordance with an outer edge of the closing front wall of the movable body, so that in a closing position, said closing front wall and said outer edge are flush;

wherein the frame is provided with a pair of first tabs facing downwards, one at each side of the lower part of an upper side of the frame, acting as an arrangement of retention in concordance with the upper edge of the lateral walls of the movable body, and said first tabs are located in a cutaway portion of the frame and being joined to a top of the cutaway portion;

retaining elements placed in front and rear zones of the movable body;

a gripping/pulling flange placed in an outer face of the front wall;

wherein the upper bridge of the movable body is provided with ribs/elevations having an upper edge provided with a toothed area/rack, said ribs/elevations being placed in parallel with the lateral walls and located at some distance from said respective lateral walls;

wherein the frame is in turn provided with second tabs which interact with the upper teeth of said ribs/elevations.

2. A dispensing lid, according to claim 1, wherein the toothed area of the upper edge of the ribs/elevations has a progressive radius of curvature from a front part thereof in which a corresponding said tab comes into contact with the upper edge of the toothed area to a fully open position, in which the tab is inserted approximately as far as half-way down the height of a tooth of the toothed area.

3. A dispensing lid, according to claim 1, wherein an upper rear end of the lateral walls of the movable body has an elevation in which the radius of curvature increases, so that said elevation comes into contact with the first tabs when the lid is in a position close to a full opening position thereof, thus limiting the capacity for movement and deformation of the movable body and improving the stability of the lid in the open position.

4. A dispensing lid, according to claim 1, wherein the upper bridge, seen in cross-section, has at least certain lateral zones located between each of the ribs/elevations forming the racks and the corresponding lateral wall, in which the radius of curvature in respect of the hinge of the lid is constant.

5. A dispensing lid, according to claim 4, wherein the upper surface of a front of the upper bridge is provided with a set of parallel ribs forming a comb, with a radius of curvature at a top in respect of the hinging axis of the lid being substantially identical to the radius of curvature of a rear of said upper bridge, and in that a front edge of the upper bridge with the set of ribs has a concave curve.

6. A dispensing lid, according to claim 5, wherein in an open position, the distance between the frame and a rear of the upper bridge is from 0.2 to 1.5 mm.

7. A dispensing lid, according to claim 3, wherein the upper bridge has a constant curve in respect of the hinge, and a lower surface provided with a set of parallel ribs forming a comb, said comb constituting a decreasing portion of said front part, and in that a front edge of the upper bridge with the set of ribs has a concave curve.

8. A dispensing lid, according to claim 1, wherein the tabs are from 2.5 to 3.5 mm high and 2.2 to 3.2 mm wide and their thickness is between 0.3 mm and 0.7 mm.

9. A dispensing lid, according to claim 1, wherein the frame comprises different outward-facing cutaways in a zone of the tabs, so as to allow said tabs to become laterally flush with a corresponding plane of the lateral walls of the movable body, said cutaway leaving a space of between 0.1 to 1.0 mm between the tab and the frame.

10. A dispensing lid, according to claim 1, wherein the frame is provided, at a rear face thereof facing towards the package, with at least one perimeter ridge, with a triangular section, whose vertex forms an acute angle, and which can be joined with an outer surface of the package by ultrasonic welding, in which the acute angle has a value of between 40° and 100° and the height of the triangular section is between 0.1 and 0.5 mm.

11. A dispensing lid, according to claim 1, wherein a rear face of the frame facing towards the package is provided with a perimeter edge adjacent to the window formed by said frame, covering roughly half of the width of sides of the frame, the height of said edge being approximately equal to that of a thickness of the package, and an outer shape of said edge being substantially identical to that of the window made in the package in which this has to be placed, and in that the frame also comprises a counter frame made of a piece of plastic material forming an interior window substantially identical to that of the frame and having sides with at least the same thickness as that of sides of the frame and which can be sealed both to the edge of the frame and to an interior surface of the package in which this has to be placed.

12. A dispensing lid, according to claim 1, wherein a rear edge of the upper bridge comprises at least a stop with a triangular section with a vertex which faces upwards, with a vertical front side and oblique rear side, in which said stop projects towards a rear of the movable body for part of its section, so that in a fully open position the rear edge of the movable body becomes flush with an interior surface of the package.

13. A dispensing lid, according to claim 12, wherein the at least one stop comprises more than one stop spaced along the length of the rear edge of the upper bridge.

14. A dispensing lid, according to claim 1, wherein lower angles of the frame, and lower angles formed by the lower bridge and the lateral walls, are rounded.

15. A dispensing lid, according to claim 14, wherein the rounded angles have a radius of from 0.5 mm to 6 mm.

16. A dispensing lid, according to claim 1, wherein a closing zone between the frame and the closing front wall, at least at one of:

a rear of the front wall, and a front surface of the frame, is provided with a sealing joint, said sealing joint being formed as a single piece with at least one of:

the front wall and the frame and injected with a softer material than the material of said lid and said frame.

17. A dispensing lid, according to claim 16, wherein the sealing joints are:

one of identical and different, one of smooth and rough and one of flat and provided with at least one perimeter ridge.

18. A dispensing lid, according to claim 1, wherein the closing front wall is substantially flat, and is provided on an outer face thereof with a slight thickening located on an inner perimeter at a certain distance from the outer edge, extending at a bottom thereof to a lower hinging edge leaving a smooth perimeter portion at lateral and upper edges.

19. A dispensing lid, according to claim 1, wherein the lid comprises a seal, in which said airtight seal covers the whole of opening joining zones between the front wall and the frame, and extends as far as the surface of the package on which this is placed.

20. A dispensing lid, according to claim 19, wherein the seal is in a shape substantially identical to that of an outer edge of the frame although the seal extends at a bottom thereof beyond the edge of the hinge, so that said seal covers said hinge in surrounding relation and reaches a portion of a plane of the package, with fixed sealing at said outer edge and on the plane of the package at the bottom.

21. A dispensing lid, according to claim 1, wherein the seal is provided with at least one flap located in at least one corner, left loosely projecting and not adhering to the front wall.

22. A dispensing lid, according to claim 1, wherein an outer surface of the front wall of the movable body is provided with a gripping flange, said gripping flange being hinged at one edge thereof in respect of said front wall, and the hinge is determined by a weakening of material at a joining zone between the front wall and the gripping flange, said gripping flange being adapted to adopt a folded position, in parallel to the lid to which the gripping flange is joined, and an unfolded, gripping position.

23. A dispensing lid, according to claim 22, wherein the joining zone occupies only a central part of the hinging edge and the lid is provided with a recess in a perimeter thickening at said joining zone where the hinge is housed.

24. A dispensing lid, according to claim 22, wherein an end opposite to the hinging end has an outward curve so that an edge of said end is slightly separated from the surface of the front wall when the flange is in the folded position.

25. A dispensing lid, according to claim 22, wherein the gripping flange is provided with at least one window and an outer surface of the front wall of the movable body is provided with hook-shaped lugs, which are inserted in and engage with said windows in the folded position, and insertion and withdrawal in the folding and opening phases respectively takes place against elastic deformation of the plastic material used for injecting the lid, and with this the lugs.

26. A dispensing lid, according to claim 22, wherein a surface of the gripping flange, located on an outside in the folded position, is rough, and in that a surface opposite to the rough surface is smooth.

27. A dispensing lid, according to claim 1, wherein the frame is provided with an extension with at least one valve which allow injection of inert gas and extraction of air from inside the package.

* * * * *